US007811120B2

(12) United States Patent
Liu

(10) Patent No.: US 7,811,120 B2
(45) Date of Patent: Oct. 12, 2010

(54) ELECTRICAL CONNECTOR HAVING IMPROVED LEDS

(75) Inventor: Zhi-Jian Liu, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/477,935

(22) Filed: Jun. 4, 2009

(65) Prior Publication Data

US 2009/0305549 A1 Dec. 10, 2009

(30) Foreign Application Priority Data

Jun. 4, 2008 (CN) ..... 2008 2 0037220

(51) Int. Cl.
*H01R 3/00* (2006.01)

(52) U.S. Cl. ..... 439/490

(58) Field of Classification Search ..... 439/490, 439/540.1

See application file for complete search history.

(56) References Cited

U.S. PATENT DOCUMENTS 6,120,318 A * 9/2000 Reed et al. ..... 439/490
6,142,822 A 11/2000 Wu
6,217,371 B1 * 4/2001 Wu ..... 439/490
6,431,919 B1 * 8/2002 Wang et al. ..... 439/680

* cited by examiner

*Primary Examiner*—Neil Abrams
(74) *Attorney, Agent, or Firm*—Ming Chieh Chang; Wei Te Chung; Andrew C. Cheng

(57) ABSTRACT

An electrical connector (100) includes an insulative housing (10) defining a number of insertion slots (112), a number of LED (Light Emitting Diode) pairs (20) received in the insertion slots, and a number of fixing portions (31) respectively inserted in the insertion slots. Each LED pair has a first and a second LEDs (21, 22) disposed side-by-side in one insertion slot to save space. Each fixing portion has a vertically extending spacer (311) disposed between the first and second LEDs of each LED pair to prevent undesirable electrical connection between the first and second LEDs.

15 Claims, 7 Drawing Sheets

ELECTRICAL CONNECTOR HAVING IMPROVED LEDS

BACKGROUND OF THE INVENTION

1. Field of the Invention

The present invention relates to an electrical connector, and more particularly to a modular jack having a set of LEDs arranged side-by-side.

2. Description of Related Art

U.S. Pat No. 6,142,822 issued to Wu on Nov. 7, 2000 discloses an electrical connector having an insulative housing defining a pair of insertion slots, a pair of LEDs (Light Emitting Diodes) respectively inserted in the slots, a pair of fixing portions respectively mounted on the insertion slots for resisting against corresponding LEDs.

It would result in space waste, since each insertion slot is adapted for receiving one LED.

Hence, an electrical connector carrying improved LEDs is highly desired.

SUMMARY OF THE INVENTION

Accordingly, an object of the present invention is to provide an electrical connector carrying LED pairs, with LED pairs occupying less space.

In order to achieve the object set forth, an electrical connector in accordance with the present invention comprises an insulative housing defining a number of second insertion slots, a number of LED pairs received in the second insertion slots, and a number of first fixing portions respectively inserted in each second insertion slot. Each LED pair has a first and a second LEDs disposed side-by-side in one second insertion slot. Each first fixing portion has a vertically extending spacer disposed between the first and second LEDs of each LED pair.

The first and second LEDs of each LED pair are received in one second insertion slot in a side-by-side fashion to thereby save the space occupied by the LEDs. The spacer 311 of the first fixing portion is disposed between the first and second LEDs of each LED pair to prevent undesirable electrical connection between the first and second LEDs.

Other objects, advantages and novel features of the invention will become more apparent from the following detailed description when taken in conjunction with the accompanying drawings.

DETAILED DESCRIPTION OF THE PREFERRED EMBODIMENT

Figure 1:
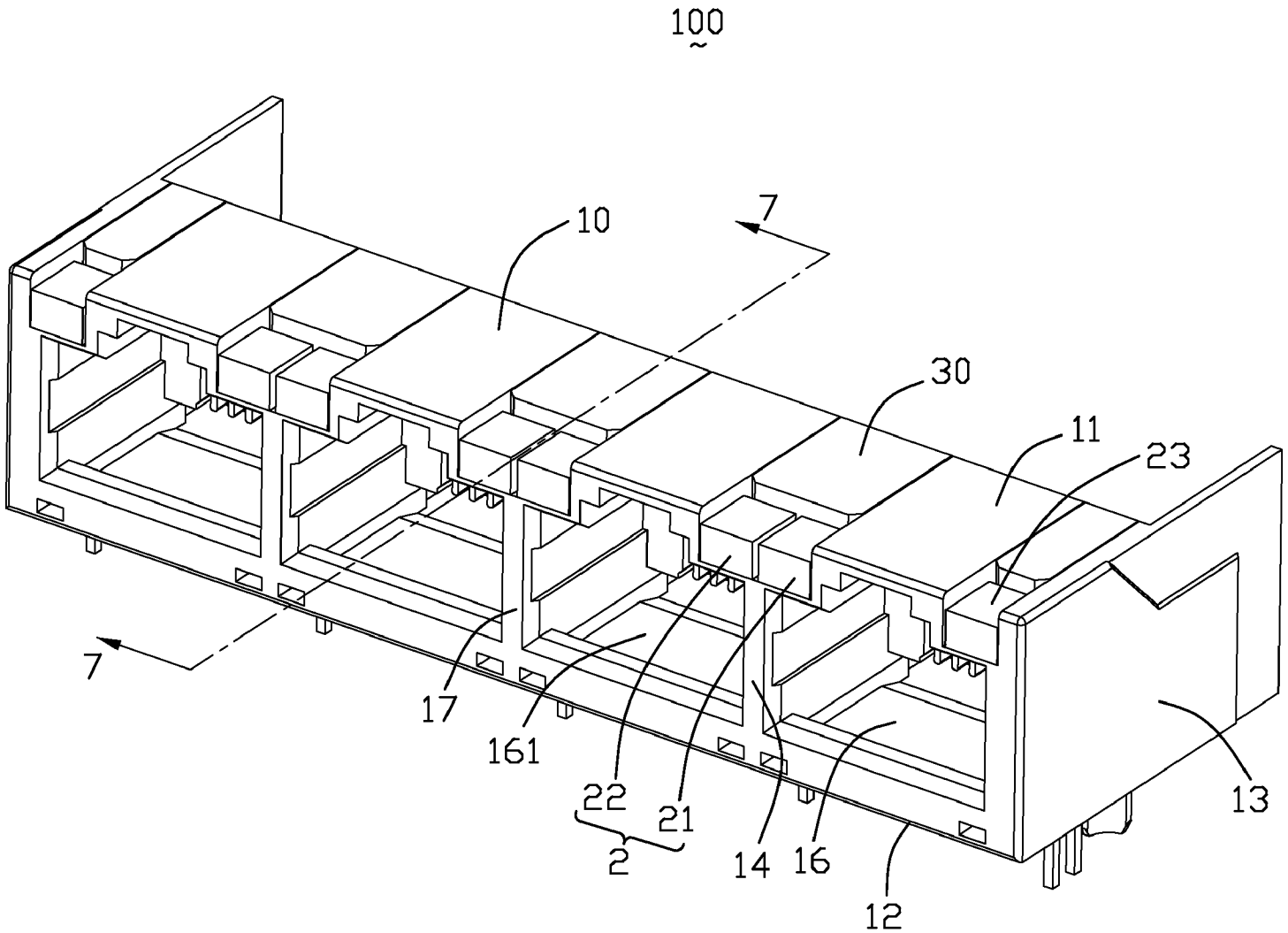
FIG. 1 is an assembled perspective view showing an electrical connector in accordance with the present invention.
Figure 2:
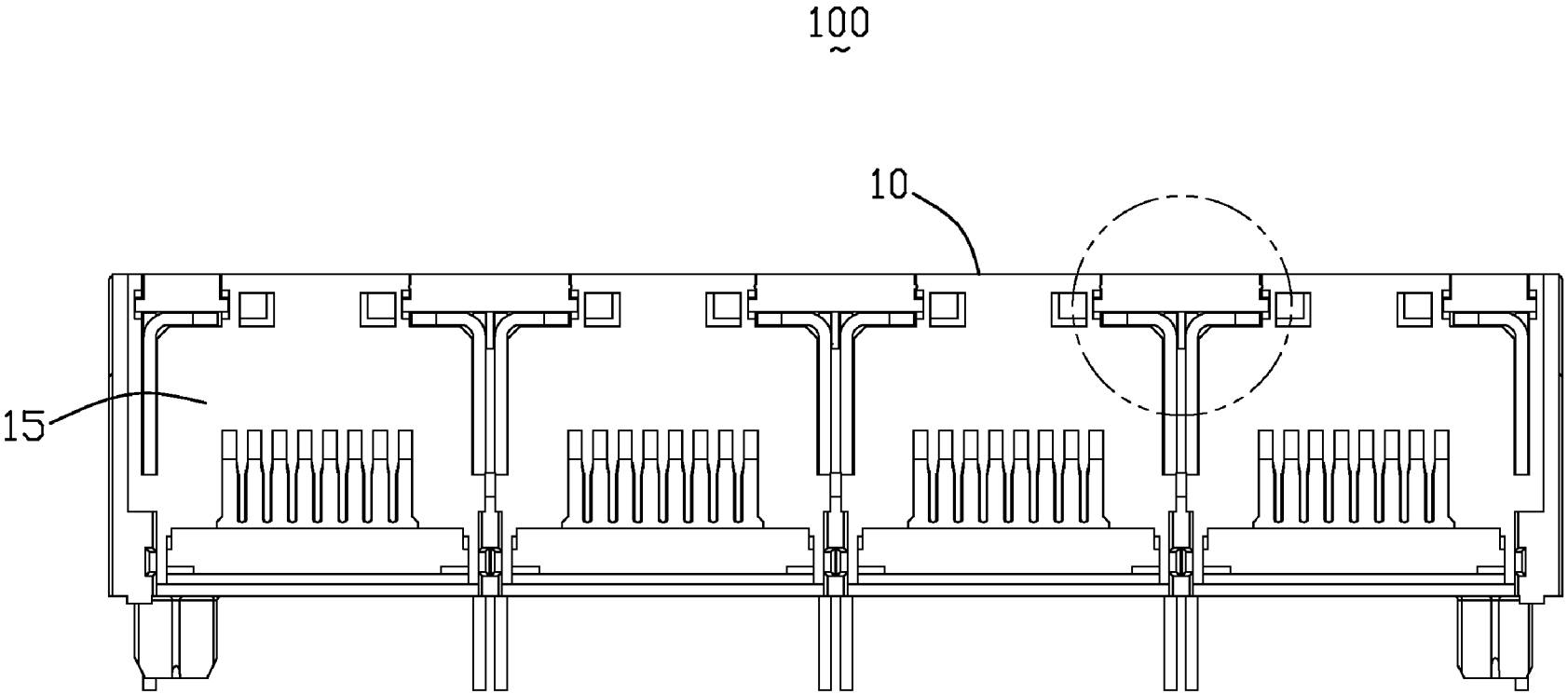
FIG. 2 is a rear view of the electrical connector as shown in FIG. 1.
Figure 3:
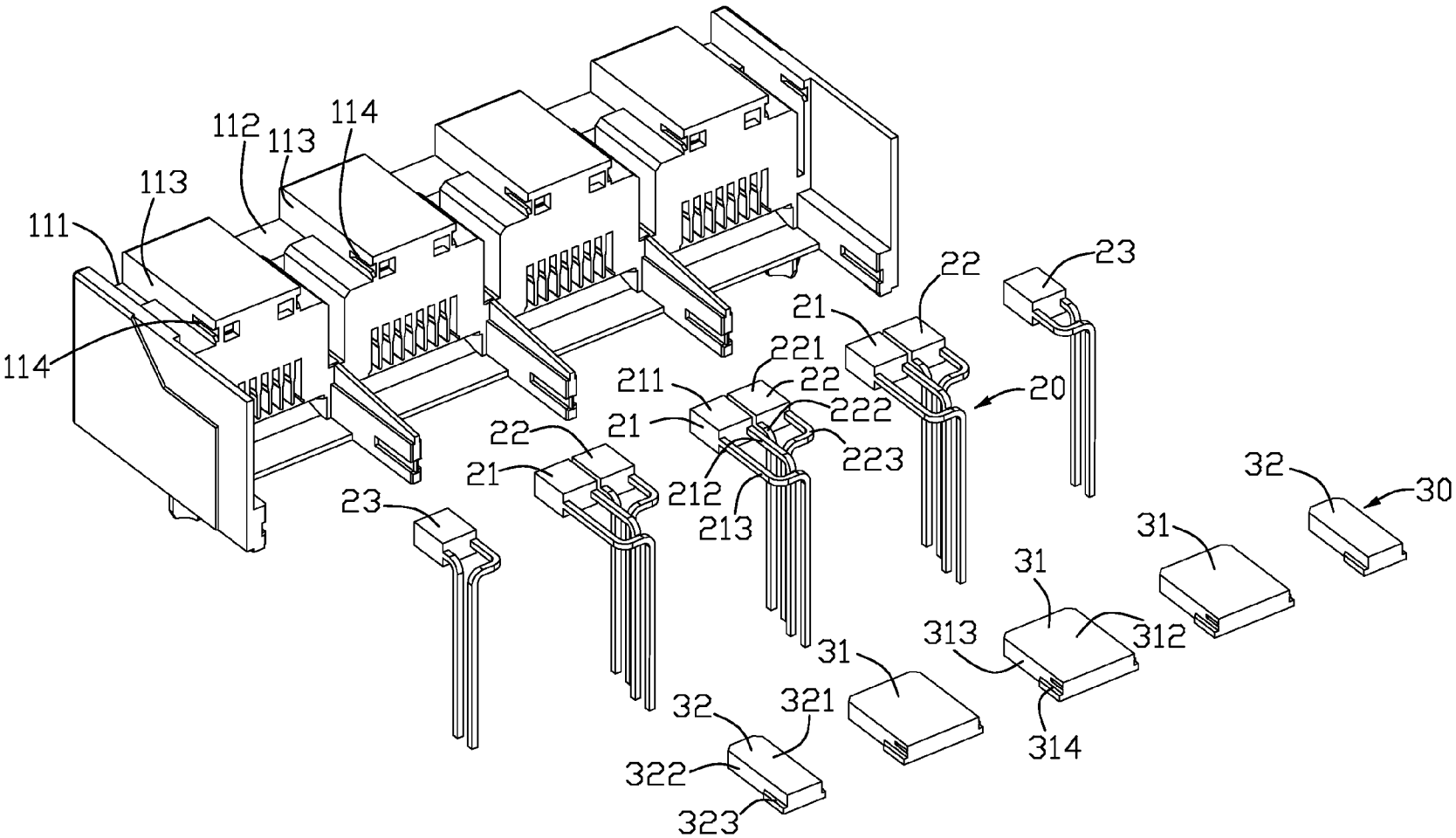
FIG. 3 is an exploded perspective view showing the electrical connector.

Reference will now be made in detail to the preferred embodiment of the present invention. Referring to FIGS. 1-3, an electrical connector 100 comprises an insulative housing 1, a plurality of terminal modules (not shown) received in the insulative housing 1, a plurality of LED pairs 20 and a pair of third LEDs 23 mounted in the insulative housing 1, and a plurality of fixing portions 30 mounted on the LED pairs 20 and third LEDs 23. The terminal modules and a shielding shell have been left out.

The insulative housing 1 comprises a bottom wall 12, a top wall 11 opposite to the bottom wall 12, a pair of periphery walls 13 perpendicular to the bottom wall 12, a plurality of mating ports 16 defined above the bottom wall 12, and a plurality of inner walls 17 each disposed between two adjacent mating ports 16. The insulative housing 1 further has a front face 14, a back face 15 opposite to the front face 14, a receiving cavity 161 defined in each mating port 16, a pair of first insertion slots 111 respectively disposed above the receiving cavities 161 and adjacent to the periphery walls 13, and a plurality of second insertion slots 112 each defined above each inner wall 17. The first and second insertion slots 111, 112 respectively have a pair of opposite side walls 113, and a pair of guiding recesses 114 defined at opposite side walls 113.

Figure 4:
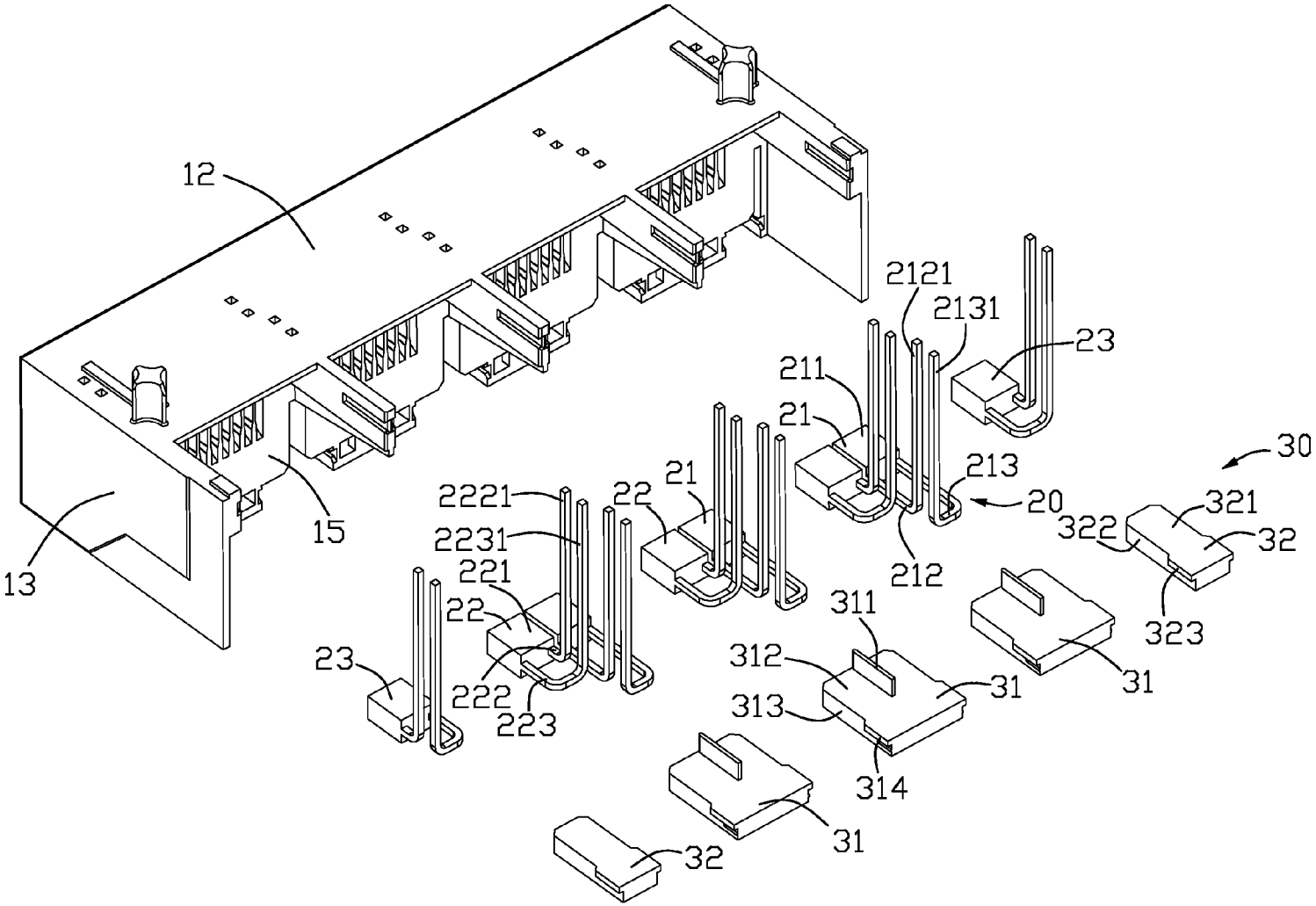
FIG. 4 is another exploded perspective view showing a electrical connector, taken from another aspect.
Figure 5:
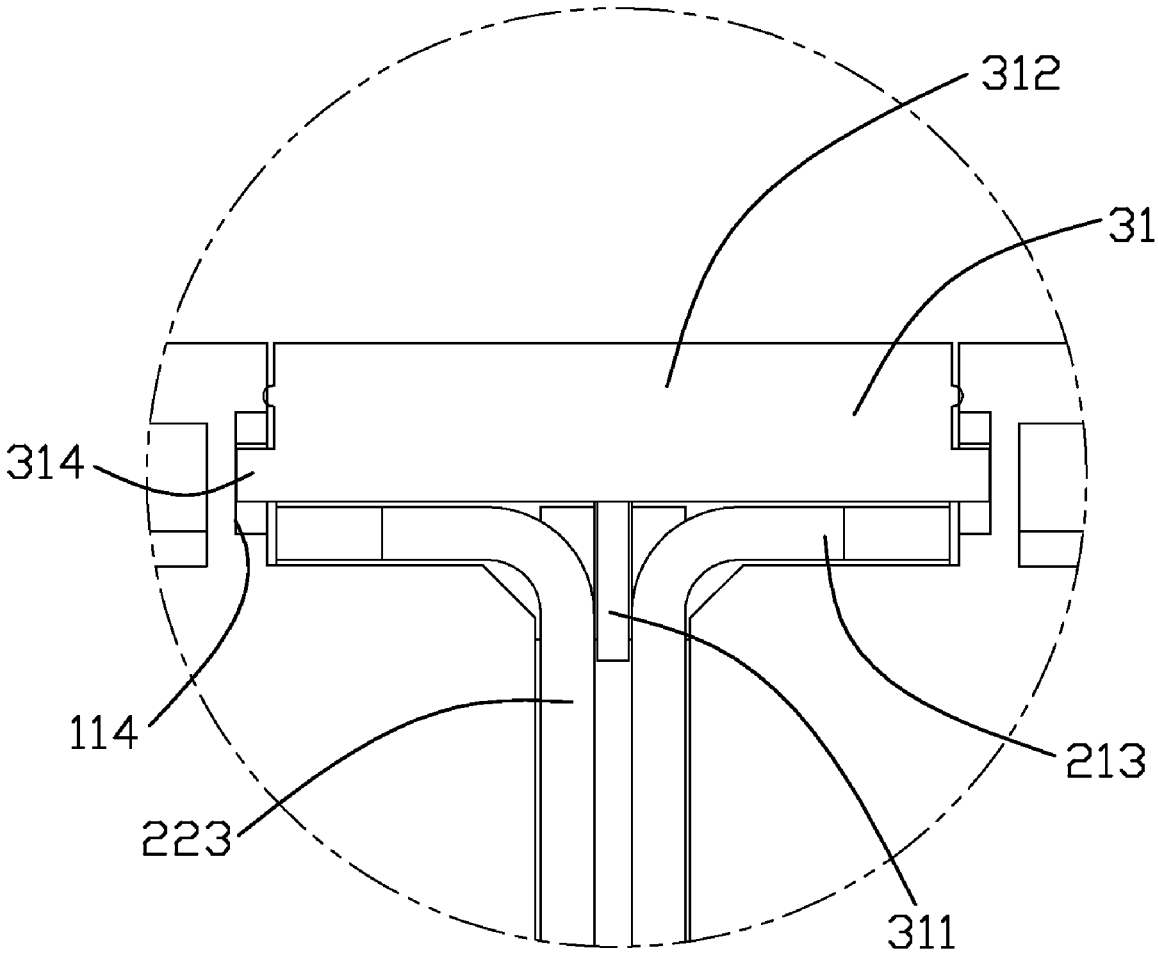
FIG. 5 is an enlarged perspective view showing the engagement between the first fixing portion and the LED pair as marked in FIG. 2.
Figure 6:
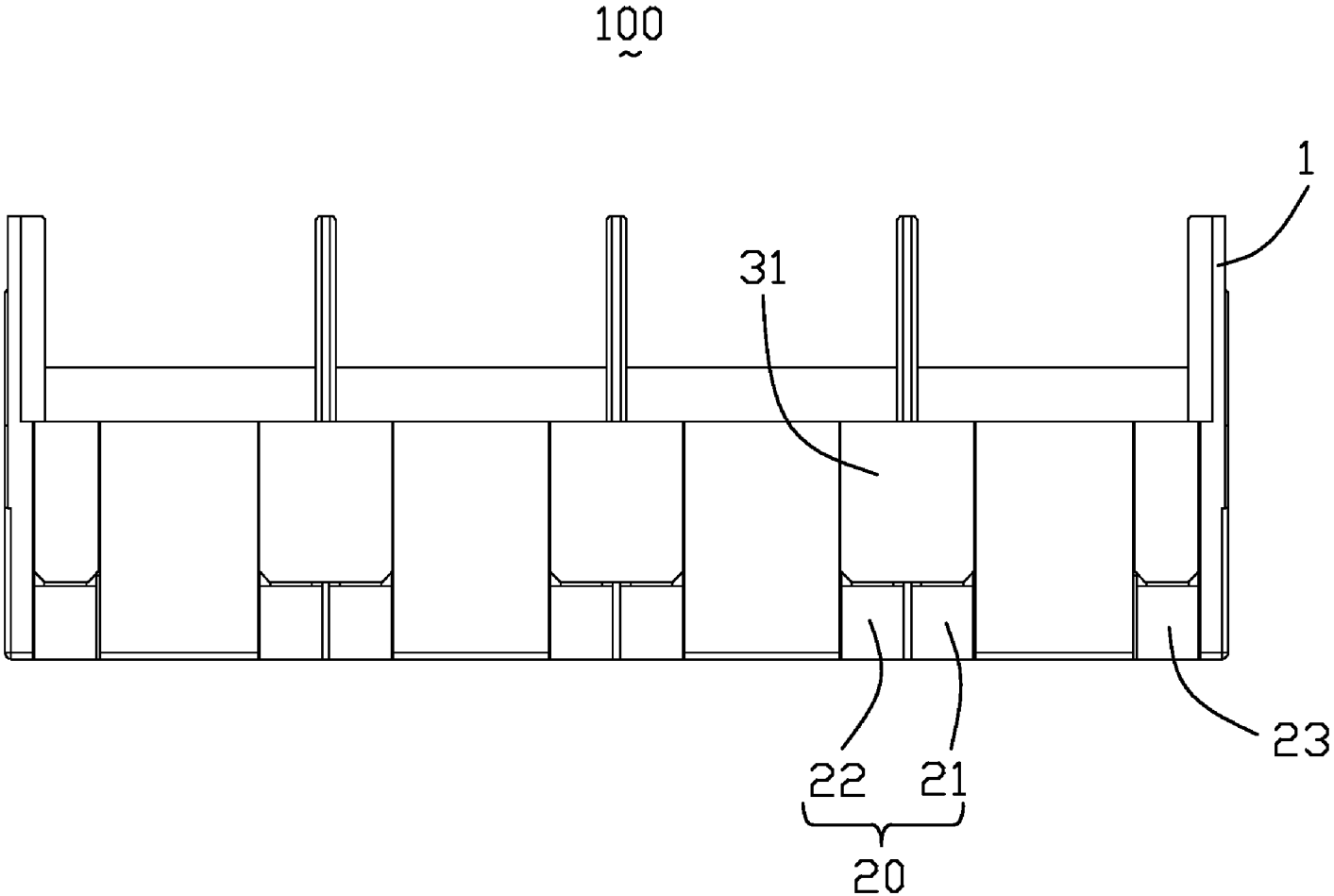
FIG. 6 is a top perspective view showing the electrical connector.
Figure 7:
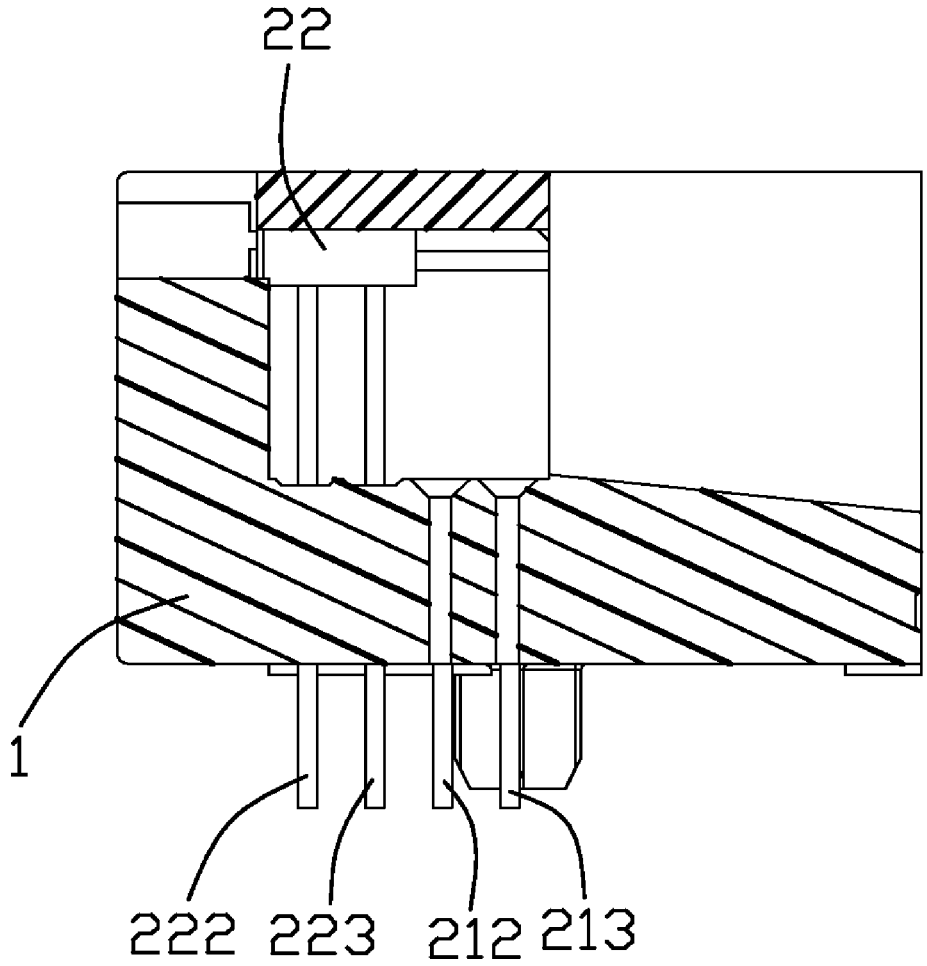
FIG. 7 is a cross-sectional view of the electrical connector, taken along line 7-7.

Referring to FIGS. 3-5, each LED pair 20 comprises a first LED 21 and a second LED 22 disposed side-by-side. The first LED 21 comprises a rectangular first visual indicator 211, an L-shaped first leg 212 and a second leg 213 fanning out from a rear portion of the first visual indicator 211. The first leg 212 extends horizontally firstly and then bends downwardly along a first vertical plane to form a first soldering portion 2121. The second leg 213 extends horizontally firstly, and then bends toward the first leg 212, and finally extends downwardly along the first plane to form a second soldering portion 2131. In conjunction with FIG. 7, the second soldering portion 2131 is disposed behind the first soldering portion 2121.

The second LED 22 comprises a second visual indicator 221, an L-shaped third leg 222 and a fourth leg 223 fanning out from a rear portion of the second indicator 221. The third leg 222 extends horizontally firstly and then bends downwardly along a second vertical plane to form a third soldering portion 2221. The fourth leg 223 extends horizontally firstly, and then bends toward the third leg 222, and finally extends downwardly along the second plane to form a fourth soldering portion 2231. The second vertical plane is parallel to the first vertical plane. The fourth soldering portion 2231 is disposed behind the third soldering portion 2221. The first leg 212 of the first LED 21 has a horizontal length larger than that of fourth leg 223 of the second LED 22, to thereby dispose the first and second soldering portions 2121, 2131 behind the third and fourth soldering portions 2221, 2231 (see FIG. 7). The third LED 23 has a configuration similar to that of the second LED 22.

Referring to FIGS. 3 and 4, the fixing portions 30 comprise a plurality of first fixing portions 31 and a pair of second fixing portions 32. Each first fixing portion 31 has a cover 312 and a spacer 311 extending downwardly from a middle portion of the cover 312. The cover 312 has a pair of side faces 313 and a pair of guiding portions 314 respectively disposed along the side faces 313.

The second fixing portion 32 has a dimension substantially half of that of the first fixing portion 31. The second fixing portion 32 comprises a cover 321 having a pair of periphery faces 322 and a pair of leading portions 323 disposed along the periphery faces 322.

Referring to FIGS. 1-7, in assembly of the electrical connector 100, the LED pairs 20 are mounted into the second insertion slots 112 firstly along an un-to-bottom direction, with the first and second LEDs 21, 22 of each LED pair 20 disposed side-by-side in one second insertion slot 112. The first fixing portions 31 are inserted into the second insertion slots 112 along a back-to-front direction to secure the LED pairs 20 within the second insertion slots 112, with the spacer 311 disposed between the first and second LEDs 21 and 22 of each LED pair 20 to prevent undesirable electrical connection between the first, second legs 212, 213 and the third, fourth legs 222, 223. The guiding portion 314 of the first fixing portion 31 engages with the guiding recess 114 of the second insertion slot 112, and the cover 31 covers the first through fourth legs 212, 213, 222, 223 to secure the LED pairs 20 within the second insertion slots 112.

Next, the third LEDs 23 are mounted into the first insertion slots 111 along an up-to-bottom direction. The second fixing portions 32 are inserted into the first insertion slots 111 along a back-to-front direction, with the leading portion 323 engaging with the guiding recess 114 of the first insertion slot 111.

The first and second LEDs 21 and 22 of each LED pair 20 are received in a same second insertion slot 112 in a side-by-side fashion to thereby save the space occupied by the LEDs. The spacer 311 of the first fixing portion 31 is disposed between the first and second LEDs 21 and 22 of each LED pair 20 to prevent undesirable electrical connection between the first, second legs 212, 213 and the third, fourth legs 222, 223.

The LED pairs 20 could be applied in a modular jack connector 100 as shown in FIGS. 1-7 and could also be applied in other types of connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of insertion slots;

a plurality of LED (Light Emitting Diode) pairs received in the insertion slots, each LED pair having a first and a second LEDs disposed side-by-side in one insertion slot; and a plurality of fixing portions respectively inserted in the insertion slots, each fixing portion having a vertically extending spacer disposed between the first and second LEDs of each LED pair.

2. The electrical connector as claimed in claim 1, wherein said first LED comprises a first visual indicator and a first and second legs connected with the first visual indicator, the first leg having a first soldering portion extending along a first vertical plane, the second leg having a second soldering portion extending along the first vertical plane.

3. The electrical connector as claimed in claim 2, wherein said second LED comprises a second visual indicator and a third and fourth legs connected with the second visual indicator, the third leg having a third soldering portion extending along a second vertical plane parallel to the first vertical plane, the fourth leg having a fourth soldering portion extending along the second vertical plane.

4. The electrical connector as claimed in claim 3, wherein said first leg of the first LED extends horizontally and bends downwardly to form the first soldering portion, said second leg of the first LED extends horizontally, bends toward the first leg and then extends downwardly to form the second soldering portion, the first leg being adjacent to the first visual indicator than the second leg.

5. The electrical connector as claimed in claim 3, wherein said third leg of the second LED extends horizontally and bends downwardly to form the third soldering portion, said fourth leg of the first LED extends horizontally, bends toward the third leg and then extends downwardly to form the fourth soldering portion, the third leg being adjacent to the second visual indicator than the fourth leg.

6. The electrical connector as claimed in claim 3, wherein said spacer of the fixing portion is disposed between the first and second vertical planes.

7. The electrical connector as claimed in claim 6, wherein said fixing portion comprises a cover covering the first through fourth legs of the LED pair to secure the LED pair within the insertion slot, said spacer extending downwardly from the cover.

8. The electrical connector as claimed in claim 7, wherein said fixing portion has a pair of guiding portions formed along opposite side faces of the cover, each insertion slot defining a pair of guiding recesses engaging with the guiding portions of the fixing portion.

9. The electrical connector as claimed in claim 1, wherein said insulative housing defines a plurality of mating ports and a plurality of inner walls disposed between two adjacent mating ports, said receiving slot defined above the inner wall.

10. The electrical connector as claimed in claim 9, wherein said insulative housing comprises a pair of periphery walls, a pair of receiving slots respectively adjacent to the periphery walls, and a pair of third LEDs respectively received in the receiving slots.

11. The electrical connector as claimed in claim 10, further comprising a pair of securing portions, each securing portion having a dimension substantially half of that of the fixing portion and securing the third LED within the receiving slot.

12. An electrical connector comprising:

an insulative housing defining a plug receiving cavity and an insertion slot located adjacent to said receiving cavity in a vertical direction;

a pair of closely juxtaposed LEDs (Light Emitting Diodes) received in the insertion slot, respectively, each of said LEDs including a visual indicator and at least one lead downwardly extending from the visual indicator; and a fixing portion fixed to the housing and cooperating with the plug receiving cavity to sandwich said pair of LEDs therebertween in said vertical direction; wherein said fixing potion includes a spacer to separate the visual indicators of said pair of LEDs in a lateral direction perpendicular to said vertical direction.

13. The electrical connector as claimed in claim 12, wherein said housing is configured to comply with the leads of the LEDs for only allowing assembling of the LED to the insertion slot in the vertical direction.

14. The electrical connector as claimed in claim 13, wherein said housing is further configured to comply with the fixing portion for only allowing assembling of the fixing portion thereto in a horizontal direction perpendicular to both said vertical direction and said lateral direction.

15. The electrical connector as claimed in claim 12, wherein tail sections of all said leads of both said pair of LEDs are aligned with one another in a front-to-back direction in the housing.

* * * * *